United States Patent [19]

Crookston

[11] 4,221,093

[45] Sep. 9, 1980

[54] SHEET METAL WALL MODULE AND WALL FORMED THEREWITH

[76] Inventor: Joseph A. Crookston, 5712 N. 24 St., Kalamazoo, Mich. 49004

[21] Appl. No.: 11,138

[22] Filed: Feb. 12, 1979

[51] Int. Cl.[3] ..... E04B 5/52

[52] U.S. Cl. ..... 52/269; 52/483; 52/404; 52/460

[58] Field of Search ..... 52/241, 483, 407, 762, 52/406, 404, 460, 269, 459, 90, 267–268; 428/83, 119, 121, 122

[56] References Cited

U.S. PATENT DOCUMENTS

| | | | |
|---|---|---|---|
| 2,158,234 | 5/1939 | Griebsch | 52/222 X |
| 2,256,394 | 9/1941 | Lamel | 52/210 |
| 2,268,907 | 1/1942 | Scott | 52/762 |
| 2,490,663 | 12/1949 | Van Uum et al. | 52/460 |
| 2,520,499 | 8/1950 | Golaz | 52/460 |
| 2,729,064 | 1/1956 | Kennedy et al. | 52/483 X |
| 2,934,465 | 4/1960 | Warp | 52/406 |
| 2,955,063 | 10/1960 | Driscoll | 52/406 |
| 3,080,022 | 3/1963 | Mote | 52/460 X |
| 3,174,191 | 3/1965 | Valsvik | 52/407 |
| 3,798,852 | 3/1974 | Nicoll, Jr. | 52/90 |
| 3,803,786 | 4/1974 | Schneider | 52/90 X |
| 4,122,639 | 10/1978 | Barrell | 52/90 |

*Primary Examiner*—Carl D. Friedman

*Attorney, Agent, or Firm*—Blanchard, Flynn, Thiel, Boutell & Tanis

[57] ABSTRACT

A vertically elongated module of sheet metal has a center panel with side flanges turned inwardly along each edge, and with narrow return flanges on the free edges of the side flanges. The upper and lower ends of the return flanges have tabs turned outwardly to the center panel, and the upper and lower ends of the side flanges are turned laterally as end flanges in lapped relation to the tabs. Turning of the end flanges leaves transverse flat nailing strips along the upper and lower ends of the module. The side flanges are of less width than the width of a standard 2×4. When erected into a wall, successive modules are secured in side-by-side relation on the wide side of a 2×4 plate by nailing their lower nailing strips along the narrow side of the lower plate, and an upper 2×4 plate is similarly secured to the upper nailing strips. Furring strips are secured along the inner sides of each pair of adjacent return flanges, with the ends of the strips abutting the plates, and with the inner sides of the furring strips flush with the inner edges of the plates. Inner panels are secured across several furring strips with the ends of the panels lapped on the inner sides of the plates. The inner panels have holes near their tops for introduction of insulating material.

9 Claims, 5 Drawing Figures

SHEET METAL WALL MODULE AND WALL FORMED THEREWITH

FIELD OF THE INVENTION

This invention relates to an improved preformed module for forming a wall.

SUMMARY OF THE INVENTION

It has previously been proposed to provide preformed metal wall modules, as in the patents to Griebsch, U.S. Pat. No. 2,158,234 and Lamel, U.S. Pat. No. 2,256,394, and Scott, U.S. Pat. No. 2,268,907. However, these known modules were structurally complex, difficult to use, and costly to manufacture and install. These known modules also were generally incapable of providing adequate thermal insulation.

Accordingly, this invention relates to an improved wall module which is continuous and of light weight. This sheet metal module coacts with upper and lower 2×4 plates, with angled inner flanges on the module and 1×2 furring strips on the flanges in load supporting relation between the plates, and with the furring strips flush with the inner sides of the plates so that inner panels can easily be nailed to the plates and the furring strips. The provision of end tabs and end flanges on the side flanges of the module provide additional areas for nailing connections and strengthen the connection without interferring with economical roll forming of the module from flat stock.

BRIEF DESCRIPTION OF THE DRAWINGS

The drawings, of which there are two sheets, show a preferred form of the wall module of the invention, and two alternative ways for incorporating it in a wall structure.

DETAILED DESCRIPTION

Figure 1:
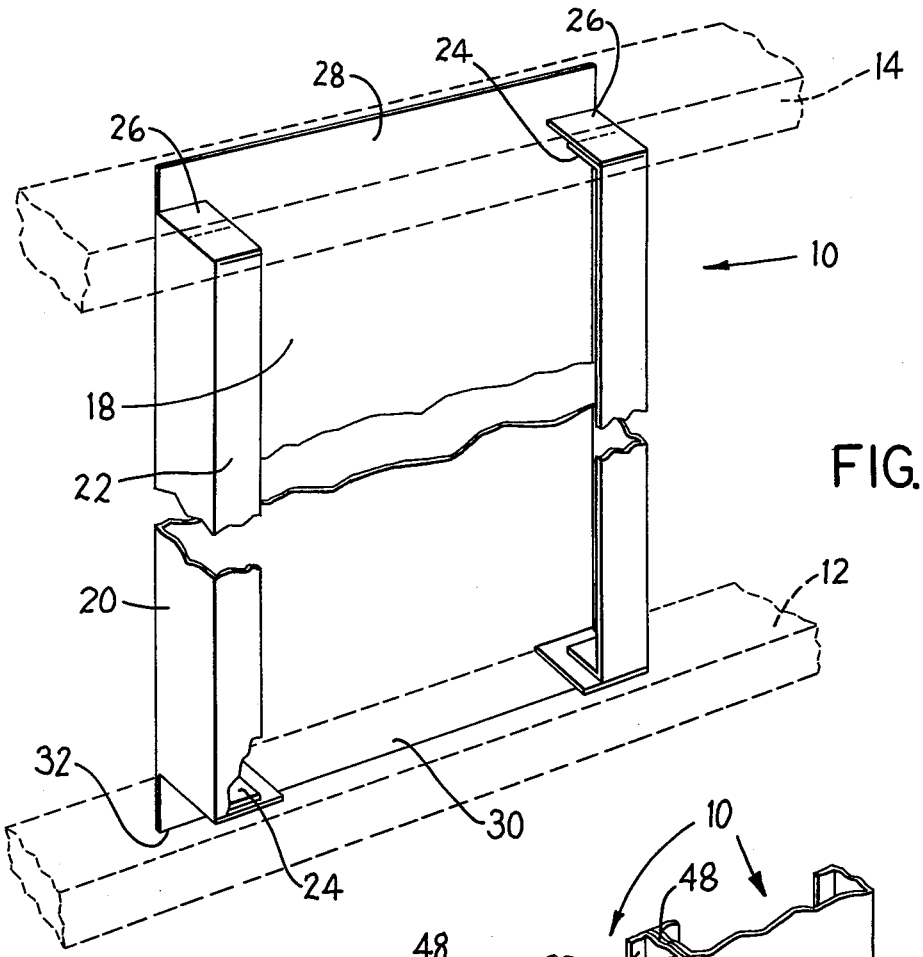
FIG. 1 is a fragmentary inside perspective view of the module as it will coact with upper and lower plate members, the plate members being shown in dotted lines.

The module unit indicated generally by the numeral 10 is designed to be erected in multiples in coacting relation with lower plate members 12 and upper plate members 14 to form a wall indicated generally at 16. Th plate members are standard wood stock commonly known as a 2×4, and the modules are made from thin aluminum stock of the order of 1/64 of an inch thick. The stock is shaped as by cutting and slitting and bending or rolling to provide a flat center portion 18 with rearwardly or inwardly extending side flanges 20 on each side and narrower return flanges 22 on the free edges of the side flanges. Slits at the upper and lower ends of the side flanges 20 permit the ends of the return flanges 22 to be bent inwardly toward the center portion 18 so as to form tabs 24, while the ends of the side flanges are bent over to form end flanges 26 in lapped relation to the tabs 24. Turning or bending over of the end flanges leaves a flat upper nailing strip 28 and a flat lower nailing strip 30 on the ends of the center portion 18. Desirably, the vertical height of the lower nailing strip 30 is slightly greater than the height of the lower plate member 12 to leave a lip or drip edge 32 on the module below the lower plate. The upper nailing strip 28 may be slightly shorter as it is usually protected by the eaves of a building.

Figure 2:
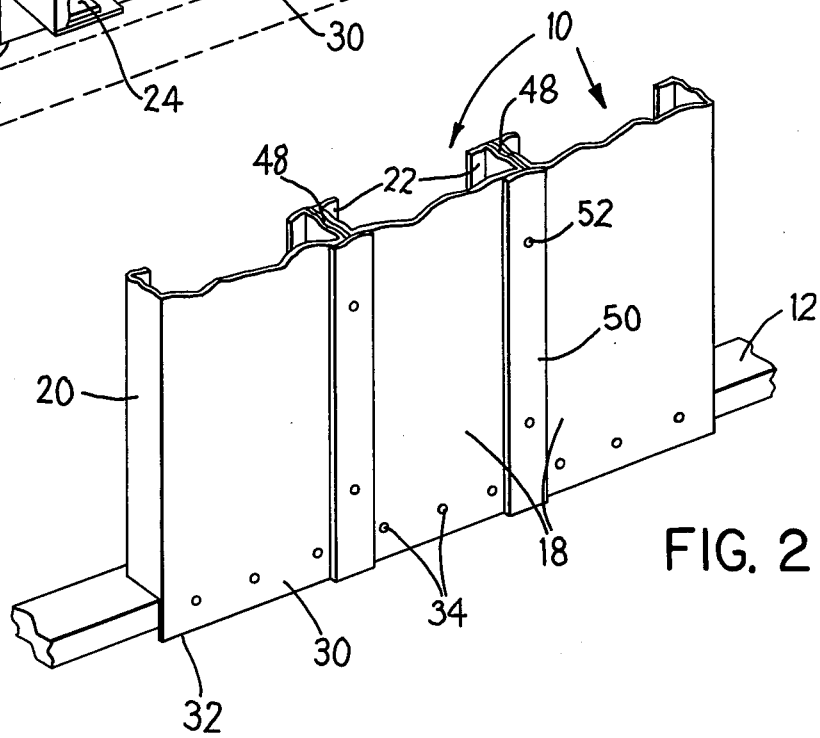
FIG. 2 is a fragmentary outside perspective view of three of the modules in erected position on a lower plate member.
Figure 3:
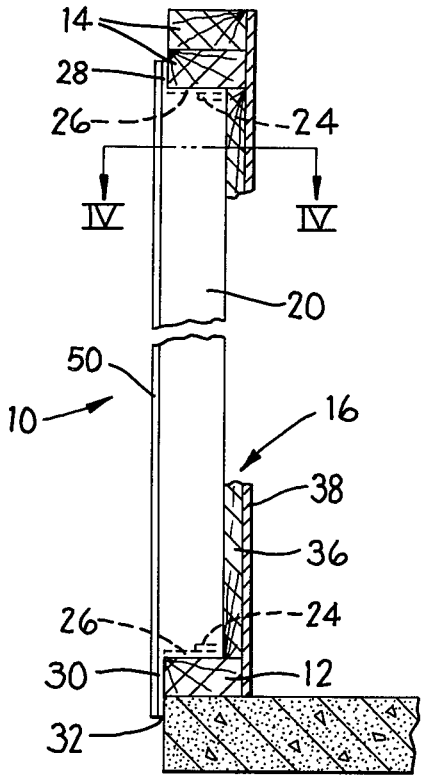
FIG. 3 is a fragmentary vertical cross sectional view taken along the plane of the line III—III in FIG. 4.
Figure 4:
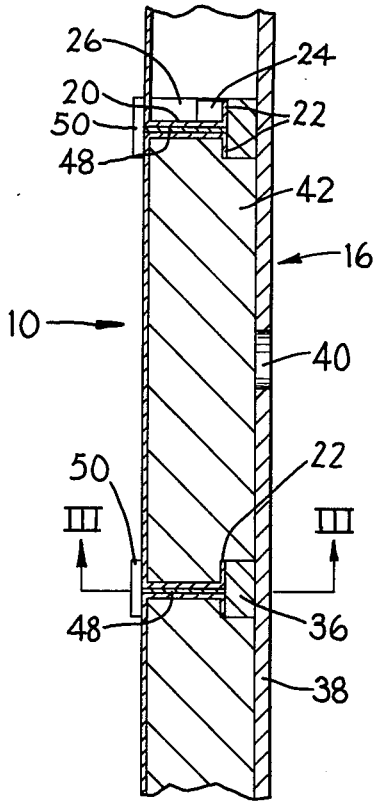
FIG. 4 is a fragmentary horizontal cross sectional view taken along the plane of the line IV—IV in FIG. 3.

After a section of the wall is erected, by nailing the nailing flanges 28–30 of adjacent modules to the plate members as at 34 in FIG. 2, conventional wood furring strips 36 are secured as by adhesive along and against each pair of adjacent return flanges 22. Desirably, the width of the side flanges 20 is about an inch less than the width of the plate member 12 and 14 so that a standard 1×2 furring strip may extend in abutting relation between the opposed horizontal surfaces of the plate members 12 and 14, and in flush relation to their inner vertical faces. An inner panel 38, such as dry wall or the like, is then secured by suitable means such as adhesive (not illustrated) across the inner surfaces of the plate members 12–14 and several of the furring strips 36. Especially when the panel 38 has load carrying properties, it coacts with the furring strips and the flanges of the modules in supporting the upper plate members 14. When the inner panels 38 have unfinished inner surfaces which are expected to be finished later or covered, holes 40 may be formed through the panels near their upper ends so that insulating material 42 may be introduced into the hollow space between the panels 38 and the modules 10 by blowing or flowing, after the entire wall has been erected.

Figure 5:
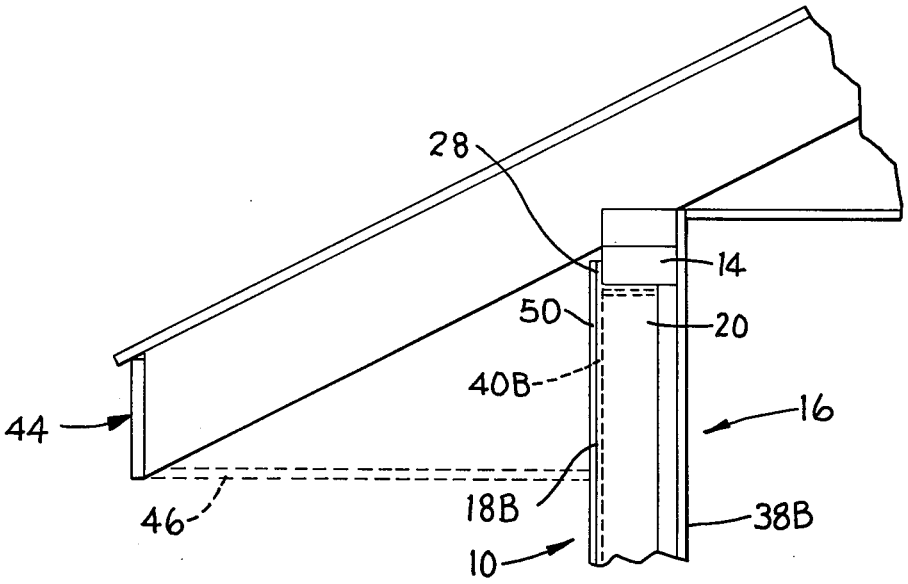
FIG. 5 is a fragmentary vertical cross sectional view through a modified form of the module and wall and the eaves portion of a coacting roof.

The modified form of the module and wall shown in FIG. 5 utilizes essentially the same construction as the preferred form of the invention, except that the inner panel **38*b* has a finished surface and it would be undesirable to form an opening therethrough. In order to provide access to the interiors of the modules for the introduction of insulating materials, a hole or opening 40*b* is formed in each of the center portions 18*b* near its upper end. In this position the opening is sheltered under the eaves of the roof 44 and may further be protected by a soffet shown by the dotted lines at 46**.

Desirably, the width of the module is slightly less than twelve inches. This leaves room for thin layers 48 of a caulking mastic or an adhesive between the side flanges 20 of the several modules 10, so that a standard building panel four feet wide will coact with four modules on twelve inch centers. With these and the other dimensions given, the modules provide adequate support for upper plate members, while eliminating the need for conventional studs and outer sheathing and siding.

A furring strip 50 (FIG. 2) may be attached to the adjacent edges of each pair of adjacent modules 10, to cover the joint therebetween, by means of screws or special nails 52 which extend into and are firmly held by the caulking 48 between the adjacent flanges 20 on two adjacent modules. This treatment gives the total an external appearance like barn siding.

Various changes may be made in the size and arrangement of parts of the module and wall without departing from the spirit and scope of the invention as defined in the following claims.

What is claimed to be new, and what is desired to be secured by Letters Patent is:

1. A vertically elongated load bearing wall module of thin sheet metal and comprising as integral parts:

a vertically elongated center panel having an upper edge, a lower edge, and vertically elongated opposite side edges, and substantially parallel vertically elongated side flanges extending in the same direction from said opposite side edges of said panel;

vertically elongated return flanges extending toward each other from the free side edges of said side flanges and end flanges extending toward each other from the upper and lower ends of said side flanges, said return flanges and end flanges and center panel together completing the peripheral wall of each of a pair of boxes which open toward each other across the width of said center panel, said side flanges respectively forming the bottoms of said boxes; and tabs extending inwardly from the ends of said return flanges toward said center panel in lapped relation with said end flanges;

said center panel having nailing strips coplanar therewith and projecting vertically beyond said end flanges at each end of the panel, said return flanges being spaced behind the plane of said nailing strips.

2. A wall module as defined in claim 1, in which said module is formed of a sheet of vertically elongated substantially rectangular shape and having two pair of parallel substantially vertical slits in the upper edge thereof substantially vertically aligned with two pair of parallel substantially vertical slits in the lower edge thereof, each of said four pair of slits being disposed close to a corresponding one of the four corners of said sheet, two pair of substantially vertical fold lines respectively terminated by the blind ends of the two pair of slits in the upper sheet edge and the two pair of slits in the lower sheet edge, said fold lines contacting said return flanges, side flanges and center panel, said slits separating said tabs, end flanges, and nailing strips.

3. A wall module as defined in claim 1 in which the width of said side flanges is materially less than the width of a standard 2×4.

4. A wall module as defined in claim 1 in which the width of said nailing strip on one end of said module as measured from the adjacent end flanges is greater than the thickness of a standard 2×4.

5. A wall module as defined in claim 1 in which the thickness of said sheet metal is of the order of 1/64 of an inch; and the widths of said side flanges and said end flanges measured perpendicularly from said center panel are of the order of one inch less than the width of a standard 2×4.

6. A modular wall comprising:

a plurality of like, vertically elongated and thin sheet metal wall modules arranged side by side, each module having a planar central panel with integral and parallel side flanges along its lengthwise edges, return flanges on the free edges of said side flanges and end flanges extending toward each other from the ends of said side flanges;

a lower plate member arranged transversely of said wall modules and in supporting contact with the end flanges at the bottoms thereof;

a top plate member arranged in supported contact with the end flanges at the tops of said wall modules;

upper and lower plate members;

integral nailing strips projecting vertically from said panels beyond said side flanges and secured in lapped relation to the edges of plate members; and furring strips secured in lapped relation to the outer sides of adjacent pairs of said return flanges and extending in abutting relation to and between the opposed sides of said plate members;

and facing panels secured in planar relation to each other and in lapped relation to the adjacent sides of said plate members and said furring strips.

7. A modular wall as defined in claim 6, in which each facing panel engages at least four of said furring strips; and there is caulking material between adjacent side flanges of said wall modules.

8. A modular wall as defined in claim 6 in which the nailing strip at the bottom of each wall module projects below the lower side of the lower plate member.

9. A modular wall as defined in claim 6 which includes insulation material disposed between the central panels and said facing panels and extending between said plate members.

* * * * *